US005467510A

United States Patent [19]

Hartzell

[11] Patent Number: 5,467,510

[45] Date of Patent: Nov. 21, 1995

[54] SOCK TAGGING DEVICE AND METHOD

[76] Inventor: Jonathan Hartzell, 8760-A Research Blvd. #210, Austin, Tex. 78758

[21] Appl. No.: 311,953

[22] Filed: Sep. 26, 1994

[51] Int. Cl.[6] ..... A44B 17/00

[52] U.S. Cl. ..... 24/706.9; 24/104; 24/DIG. 29

[58] Field of Search ..... 24/706.9, 704.1, 24/703.1, 104, DIG. 29; 40/669, 668; 2/239, 144

[56] References Cited

U.S. PATENT DOCUMENTS

| | | | |
|---|---|---|---|
| 1,198,567 | 9/1916 | Morley . | |
| 1,454,004 | 5/1923 | Weiss | 24/104 |
| 3,025,528 | 3/1962 | Minter | 2/144 |
| 3,041,743 | 7/1962 | Monsma | 36/1 |
| 3,699,617 | 10/1972 | Hofmeister | 24/81 GS |
| 5,038,413 | 8/1991 | Ursino | 24/DIG. 29 |
| 5,095,596 | 3/1992 | Dahood | 24/704.1 |
| 5,357,660 | 10/1994 | Smith | 24/DIG. 29 |
| 5,367,809 | 11/1994 | Ross | 24/DIG. 29 |

FOREIGN PATENT DOCUMENTS

| | | | |
|---|---|---|---|
| 1105961 | 12/1955 | France | 24/704.1 |
| 1284306 | 1/1962 | France | 24/104 |

*Primary Examiner*—Victor N. Sakran

[57] ABSTRACT

A sock tagging device and associated method for tagging socks to facilitate their mating, sorting and selection. The preferred embodiment of the device comprises four color-coded components including a tack (1), so named for its resemblance to a common thumbtack, a washer (19), a cap core (14), and a cap ring (17), the core and ring together constituting a dome-shaped cap (18). When the device is attached to the upper portion of a sock, held securely in place by internal friction alone, cap (18) protrudes on the outer side of the sock fabric while the circular base of the tack, called the tack disc (3), appears on the inner side. Immediately surrounding the circumference of the tack disc can be seen the peripheral portion of the larger diameter washer (19) underlying it. The dual component, dome-shaped cap (18) displays a concentrically sequenced color pair matched by the cap color pair of another such device attached to an appropriate sock mate. The tack disc (3) bears one of several bright and easily recognizable colors to signify, even under dim lighting conditions, the fundamental color category to which its sock belongs. The color of the underlying washer (19), the outer edge of which can be seen peripherally surrounding the tack disc, serves to identify the owner of the sock. By noticing whether a sock features a protruding dome-shaped cap or a flat tack disc, an observer is immediately aware of the inside-out, right side-out status of that sock.

4 Claims, 11 Drawing Sheets

FIG. 7

CORE COLORS

| RING COLORS | BLACK | GREY | WHITE | RED | PINK | ORANGE | YELLOW | GREEN | BLUE | VIOLET |
|---|---|---|---|---|---|---|---|---|---|---|
| BLACK | BLACK BLACK | GREY BLACK | WHITE BLACK | RED BLACK | PINK BLACK | ORANGE BLACK | YELLOW BLACK | GREEN BLACK | BLUE BLACK | VIOLET BLACK |
| GREY | BLACK GREY | GREY GREY | WHITE GREY | RED GREY | PINK GREY | ORANGE GREY | YELLOW GREY | GREEN GREY | BLUE GREY | VIOLET GREY |
| WHITE | BLACK WHITE | GREY WHITE | WHITE WHITE | RED WHITE | PINK WHITE | ORANGE WHITE | YELLOW WHITE | GREEN WHITE | BLUE WHITE | VIOLET WHITE |
| RED | BLACK RED | GREY RED | WHITE RED | RED RED | PINK RED | ORANGE RED | YELLOW RED | GREEN RED | BLUE RED | VIOLET RED |
| PINK | BLACK PINK | GREY PINK | WHITE PINK | RED PINK | PINK PINK | ORANGE PINK | YELLOW PINK | GREEN PINK | BLUE PINK | VIOLET PINK |
| ORANGE | BLACK ORANGE | GREY ORANGE | WHITE ORANGE | RED ORANGE | PINK ORANGE | ORANGE ORANGE | YELLOW ORANGE | GREEN ORANGE | BLUE ORANGE | VIOLET ORANGE |
| YELLOW | BLACK YELLOW | GREY YELLOW | WHITE YELLOW | RED YELLOW | PINK YELLOW | ORANGE YELLOW | YELLOW YELLOW | GREEN YELLOW | BLUE YELLOW | VIOLET YELLOW |
| GREEN | BLACK GREEN | GREY GREEN | WHITE GREEN | RED GREEN | PINK GREEN | ORANGE GREEN | YELLOW GREEN | GREEN GREEN | BLUE GREEN | VIOLET GREEN |
| BLUE | BLACK BLUE | GREY BLUE | WHITE BLUE | RED BLUE | PINK BLUE | ORANGE BLUE | YELLOW BLUE | GREEN BLUE | BLUE BLUE | VIOLET BLUE |
| VIOLET | BLACK VIOLET | GREY VIOLET | WHITE VIOLET | RED VIOLET | PINK VIOLET | ORANGE VIOLET | YELLOW VIOLET | GREEN VIOLET | BLUE VIOLET | VIOLET VIOLET |

FIG. 8A
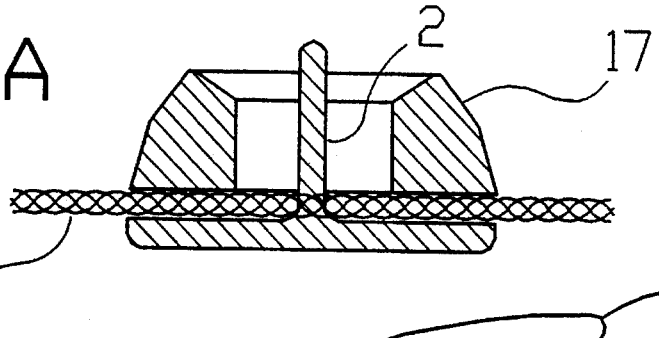
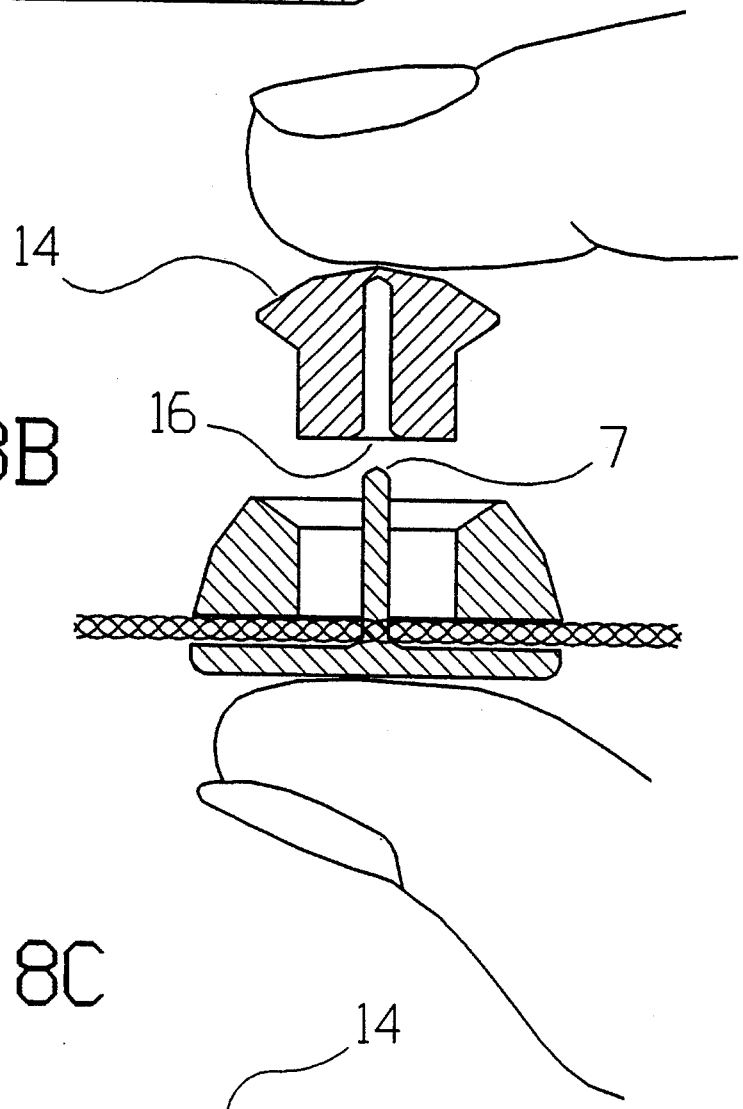
FIG. 8B
FIG. 8C
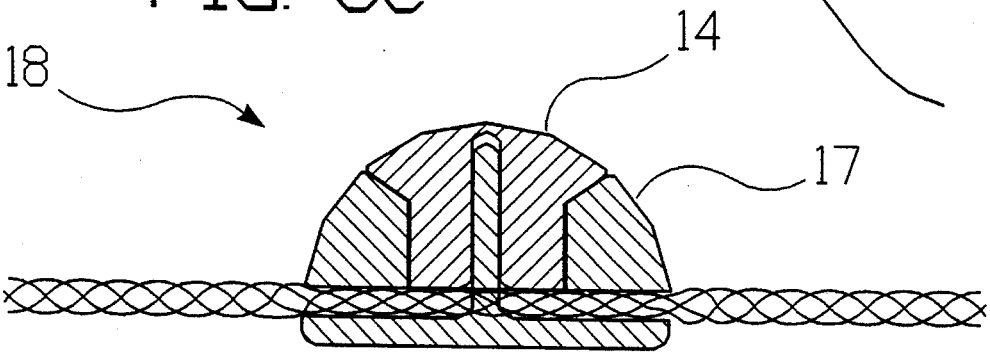

SOCK TAGGING DEVICE AND METHOD

BACKGROUND/FIELD OF INVENTION

This invention relates to a fabric tagging device, and particularly to such a tagging device which, when used in multiplicity and attached to a plurality of socks, presents visual cues that facilitate the mating, sorting and selection of such tagged socks.

BACKGROUND/PRIOR ART

Though Albert Einstein was occasionally seen to be wearing flagrantly mismatched socks when delivering his lectures at Cal Tech, his many students, colleagues and admirers gave little notice to the fact. It was understood that this famous Father of Relativity was a world-class genius whose mind operated on a plane far above that of the mundane, and far removed from concerns of combed hair, tucked shirts and fastened flies.

If it were only true that the wearing of mismatched socks signified genius, nearly everyone could easily claim close intellectual kinship with Einstein. Unfortunately, however, no such hallmark of genius has been established or proven. So it is quite understandable, then, that the average person, having discovered that he or she has been wearing wrong-colored socks, will do all within reason to hide the oversight.

While most of those experienced in the realm of romance will agree that finding the perfect mate can be both time consuming and frustrating, the same happens to hold true in the realm of sock sorting. Almost all incidents of sock mismatching can be traced directly back to the sock sorting and mating process that tends to take place shortly after the washing-drying cycle. Ideally, of course, such sorting would be done under optimal lighting conditions wherein the lighting is both abundant and spectrally balanced; in short, the illumination would be bright and white. In reality, however, lighting conditions are generally far less than optimal in the various locations where sorting usually takes place. For example, there are many who sort socks while watching television in a relatively dim room; many spread their newly laundered socks across the expanse of a bed and proceed to sort under less-than-favorable bedroom lighting conditions. Bachelors have been known to dump their unsorted socks into a large drawer, and then to pick amongst the chaotic mass in the dim morning light while rushing to get ready for work.

The sorting and mating of socks was relatively easy several decades ago, when socks were made of thinner fabric and frequently featured sporty and imaginative patterns and designs. In those earlier days it was also easy to distinguish between the socks of a father and his thirteen-year-old son, for there was a visible size difference in the socks.

On the other hand, today's socks are generally more luxuriant in thickness and softness, and for the most part are of a solid color with no distinctive patterns or designs. Furthermore, they tend to be uniform in size, whereby one size does indeed fit all. While the increased thickness and softness of today's socks certainly provide more comfort for the wearer, unfortunately such plush weaves also result in decreased color reflectance, making it more difficult for the sorter to discriminate, for example, between a dark blue and a black sock under anything but the most favorable of lighting conditions. In fact, even when socks have been properly mated, it can still be easy for the person getting dressed to mistake a pair of dark browns for a pair of dark blues in the subdued light of an early morning or evening.

Later on, however, bright lighting at the workplace or social gathering is likely to reveal the mistake not only to the sock wearer, but also to everyone else nearby. Brown socks mismatched to a blue suit can be just as much a problem as mismatched socks themselves.

At this point it has become evident that there are two considerations that come into play in both the sorting and subsequent selection of socks, the first of which is the actual pairing or mating, and the second being the wearer's successful selection of a pair of the desired color. But there is also a third concern of equal importance which should be addressed as well: Consider the man who, having taken care to insure that his socks are perfect mates, holds the pair under bright sunlight near the bedroom window to verify they are of the proper color, yet discovers, just as he puts them on, that he is nevertheless wearing the wrong socks, the fact being brought to his attention by a younger male voice echoing up the stairwell, "Hey, Mom . . . Dad . . . where are my favorite blue socks?"

Although ownership, the third factor, tends not to apply in the bachelor's case, it is certainly relevant in the family household. In such a setting the sorter of the family's socks must not only mate them properly, but also distribute the mated pairs so they get to their rightful owners. The factors mentioned earlier that contribute to the difficulty of mating socks into pairs are also responsible for the considerable amount of time and effort spent, as well as the occasional mistakes made, in the process of sorting those pairs into the various piles corresponding to their ownership.

In years past there have been various devices and methods proposed for the purposes of either tagging items of clothing, or for attaching related items or pairs of items together. Although the operating principles of many of these prior inventions can be partially applied toward solving the problems involving the identification and sorting of socks, no single device succeeds in addressing the issue thoroughly.

In U.S. Pat. No. 3,699,617 granted 24 Oct. 1972 to John M. Hofmeister, the inventor proposes a connecting device for detachably joining two socks. The notion of joining the two members of a sock pair before placing them in the washer has certainly occurred to many a housewife, and in principle the idea has some merit.

Unfortunately, however, the successful operation of Hofmeister's invention is entirely dependent on the cooperation of the sock wearer, who must be instructed to remember to join his or her socks together after removing them at the end of the day and before throwing them in the laundry basket.

Another drawback involved with such an approach is the tendency for joined laundry articles to intertwine during the random agitation cycles in a washing machine. Such twisting and tangling occurs most intensely at the point of juncture itself. To make matters worse, all of the pulling, twisting and tugging exerted upon the socks during the agitation cycles is concentrated at the relatively small junction point, which can bring about stress and deformation of the socks where the device is attached.

A further disadvantage inherent in the invention is found in the rectangularity of the design, and particularly in the V-shaped notch that is formed at the juncture of the two connectors. Such sharp angles and deep recesses invite the occurrence of snags involving trailing threads from other clothing that tend to wrap themselves around such features.

Another problem with the device is the fact that the sock owner identification plates must be attached for wearing and detached for laundering. What began as an idea for saving time and effort for the sock washer seems in the end to demand more concern and attention on the part of the sock wearer.

U.S. Pat. No. 3,025,528 granted 20 Mar. 1962 to James W. Minter proposes tie markers for facilitating consistency and accuracy in tying neckties. Each device clamps over the edge of the tie fabric at a specified length along the tie, using a piercing point that penetrates the fabric for sturdy attachment. Although the protruding feature of the marker is rounded, rather than rectangular, and thereby not likely to invite snagging, it is not intended for use in marking socks, as its hinged clamping design limits it to being attached at the very edge of the fabric. Furthermore, it cannot practically present the various kinds of information that would fully facilitate sock mating, sorting and selection.

U.S. Pat. No. 1,198,567 granted 19 Sep. 1916 to M. E. Morley proposes a retainer for keeping overshoes in place. The device utilizes a piercing stud with a wide, flanged base and a grooved end. A metal cap snaps onto the end of the stud, thereby locking itself in position. This is an example of a piercing, but non-hinging, attachment which would have some potential for use in tagging socks, yet which is unfortunately too complex in terms of its mechanics, and too limited in terms of conveying information.

The notion of keeping pairs of items from getting mixed up with others is seen in U.S. Pat. No. 3,041,743 granted 03 Jul. 1962 to Shirley M. Monsma. The connecting device is designed to unite pairs of soft footwear, and even boots, by providing permanently affixed detachable couplers to each item. Although the idea could work well with the soft shoes and boots depicted in the patent, such footwear would be badly damaged if subjected to a washing machine while coupled in that manner, due to the high stresses concentrated in very small areas of the material. Here is another example of the potential problem involved when one seeks to mate certain items of apparel and then subject those items to laundering and drying cycles while they are still mated.

In U.S. Pat. No. 5,095,596 granted 17 Mar. 1992 to Michael K. Dahood, a fabric marker is proposed that features a piercing element and a locking cap, both of which are unnecessarily complex in design. Although the description of the fabric marker gives examples involving the marking of socks, unfortunately the invention focuses much more on the mechanics of its locking attachment mechanism than upon solving the actual problems and issues relating to socks. Ironically, however, even the locking mechanism design itself presents a problem, for it has only two locking positions that will accurately accommodate only two thicknesses of sock fabric. If the sock fabric should turn out to be of an intermediate thickness, the device would remain somewhat loose against the fabric, inviting snags and entanglement with straying threads from nearby garments during laundering. A partial solution to this is offered in the form of so-called stabilizing posts located near the periphery of the piercing element base. These three posts are supposed to partially penetrate the fabric and intercept straying threads, thereby preventing them from winding around the central post. Unfortunately, such wandering threads are still free to wrap themselves around the outer posts themselves. The stabilizing posts are also supposed to keep the device from rotating freely, yet the posts would not be necessary if the fundamental method of attachment were less complex and more accommodating to varying thicknesses of fabric.

Another disadvantage is found in the fact that the locking cap protrudes ninety degrees outward from the exterior of the fabric to which it is mounted. Such sharp outward projection makes the entire device subject to the many random forces, impacts and momentary entanglements that take place in the laundering environment. It is, in fact, the design of the cap itself that brings into being the very forces that must then be overcome by the unnecessarily elaborate locking mechanism.

A further problem with the fabric marker is the method suggested by which it is supposed to impart information. Although he spent a good deal of effort in the description of the locking mechanism, Dahood overlooked several important factors relating to its use as a marker, particularly in regard to the marking or tagging of socks. The locking cap depicted in the drawings is essentially a closed right cylinder with a raised square surface on its top side. It is suggested that markings or designs be inscribed or printed on the surface. Unfortunately, such an arrangement limits the effective range of viewing angles from which such insignia can be reliably recognized.

Furthermore, considering the small size of the device, recognition of such markings would require relatively close scrutiny. Although Dahood loosely suggests that the cap could be of a different design or shape, he fails to suggest even one alternative. Although the device he proposes may find some kind of application in the general field of fasteners or fabric markers, it seems to offer little help to the housewife, husband or bachelor who is confronted with having to mate and sort a formidable pile of freshly laundered socks.

In summary, although each example of prior art cited above has some virtue or aspect that can be applied toward solving some of the problems encountered in the three activities of mating, sorting and selection of socks, none provides a practical device or method that addresses all three activities simultaneously.

OBJECTS AND ADVANTAGES

The present invention, addressing specifically and particularly the field of activities relating to the mating, sorting and selection of socks, endeavors to accomplish the following objects and to provide the following advantages:

A. To provide a sock tagging device whose mechanism for attachment is both simple and reliable;

B. To provide a sock tagging device whose physical design and form is immune to snagging and entanglement by loose or stray threads during laundering;

C. To provide a sock tagging device capable of conveying information without the use of letters, numerals, written characters, written symbols or written designs of any kind;

D. To provide a sock tagging device whose visual cues can easily be seen and recognized from a wide range of viewing angles;

E. To provide a sock tagging device capable of conveying a visual indication that facilitates the rapid and accurate mating, or pairing, of socks;

F. To provide a sock tagging device that presents an easily recognizable indication of the color category to which a sock, or pair of socks, belongs;

G. To provide a sock tagging device that presents an easily recognized indication designating the ownership of a given sock;

H. To provide a sock tagging device that presents an easily recognized indication of the inside-out, right side-out status of a given sock.

BRIEF DESCRIPTION OF THE DRAWINGS

FIG. 7 shows a ten-color by ten-color grid that demonstrates the various ordered pair color combinations that can be utilized with the second embodiment;

FIG. 8A shows the cap ring placed over the tack's piercing post after the post has penetrated the sock fabric;

FIG. 8B shows the cap core being pressed into position over the piercing post;

FIG. 8C shows the dual-component cap seated properly into position, sandwiching the sock fabric between itself and the tack disc;

REFERENCE NUMERALS IN DRAWINGS

Figure 1:
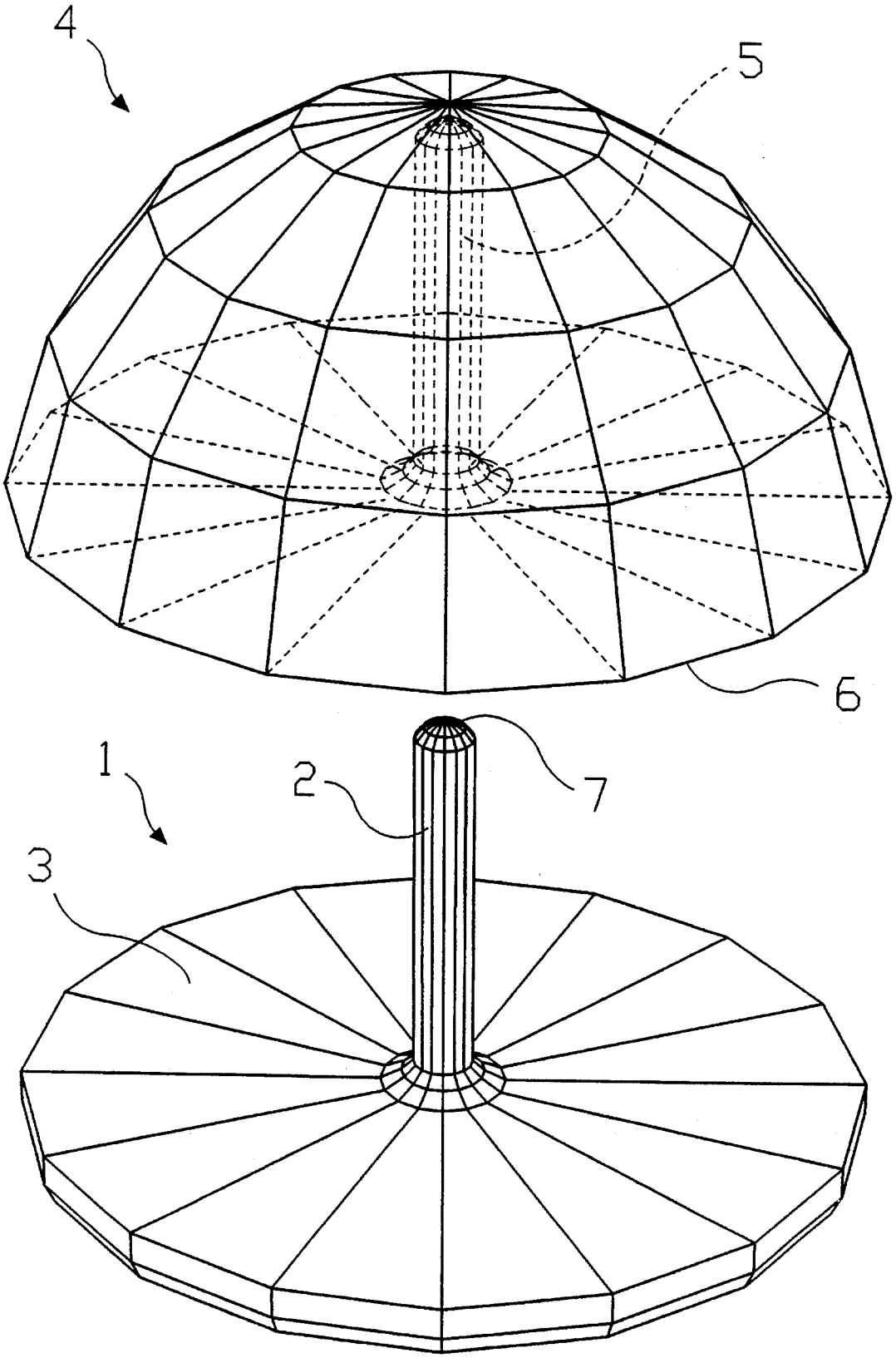
FIG. 1 shows the tack and cap, the two components of the first embodiment.
Figure 2:
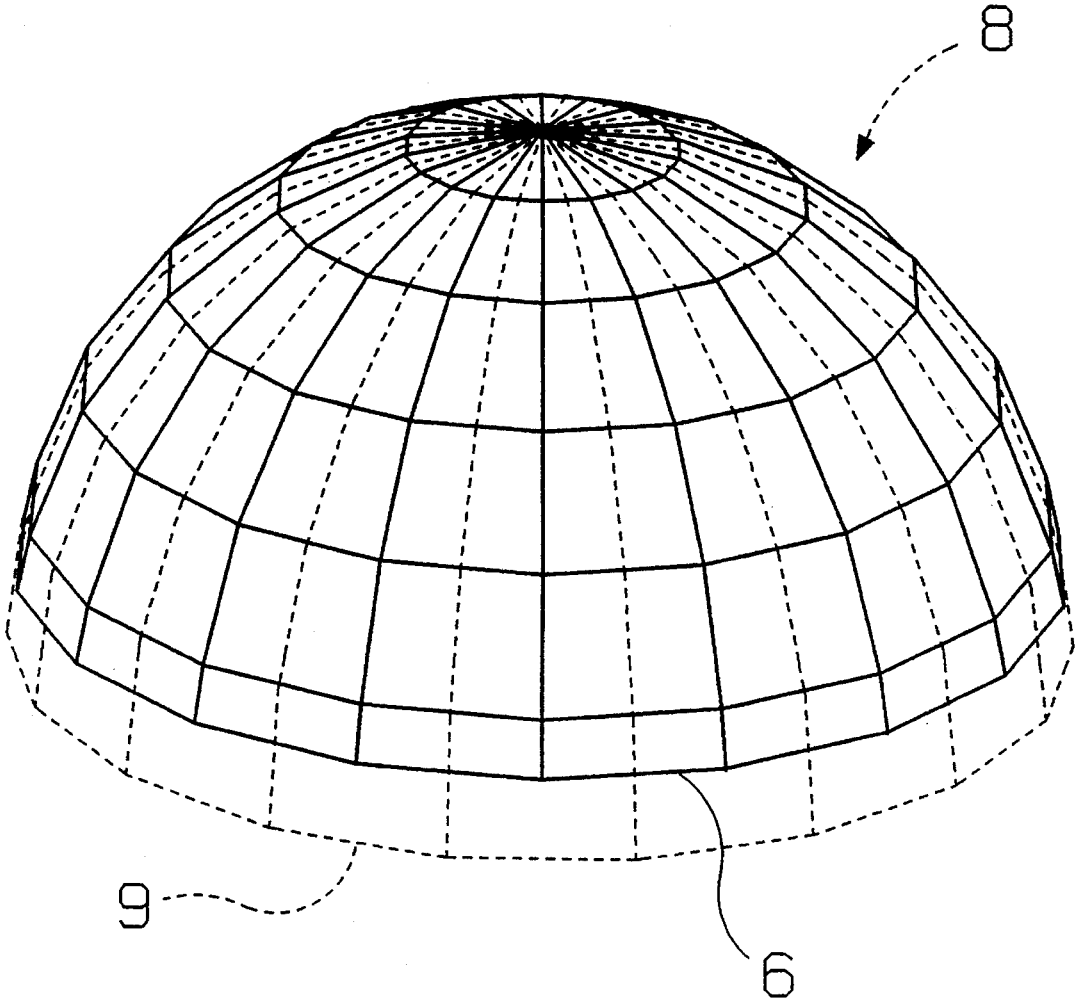
FIG. 2 shows the line of truncation of a hemisphere that yields the suggested dome shape of the cap of the first embodiment.

Introduced in FIG. 1
1. Tack
2. Piercing Post
3. Tack Disc
4. Cap
5. Receiving Hole (single-component cap of first embodiment)
6. Circular Base Facet of Cap (single-component cap of first embodiment)
7. Piercing Post Point
Introduced in FIG. 2
8. True Hemisphere
9. Hemisphere Base
Introduced in FIG. 3
10. Sock Tagging Device
11. Sock
12. Sock Fabric
Introduced in FIG. 4
13. Over-folded Sock Cuff
Introduced in FIG. 6
14. Cap Core (dual-component cap of second embodiment)
15. Cap Core Base Facet (dual-component cap of second embodiment)
16. Cap Core Receiving Hole
17. Cap Ring (dual-component cap of second embodiment)
Introduced in FIG. 8
18. Dual-Component Cap
Introduced in FIG. 9
19. Washer
20. Washer Hole

DESCRIPTION OF THE INVENTION

OVERVIEW

To provide a clear understanding of the invention it will be advantageous to begin with a statement of its overall purpose. The concept and design of the sock tagging device herein described is not only focused on facilitating and simplifying the post-laundry task of mating and sorting socks, but also upon assisting the sock wearer to accurately and confidently select a pair of socks of the desired color category, even under the most unfavorable lighting conditions.

Of the many different kinds of clothing articles that appear in a given load of laundry, socks seem to be the most uniform in appearance, not only sharing the same general shape, but also more recently having similar physical dimensions, one size in many instances being designed to fit all.

Upon picking up a sock and looking at it, an interesting thing happens when the average person encounters difficulty in discerning its exact color, weave pattern, or whether it is inside-out: The person instinctively moves toward a source of brighter light, in many cases preferring the more balanced and natural light available near a window. Color recognition is one of the important visual perceptions that are enhanced by increased lighting. As a dark green sock reflects mostly the green component of white light, it follows that an increased amount of white light falling upon the sock will result in a greater and more perceptible green component being reflected toward the viewer's eye. Hence it is both natural and practical for one to move toward brighter light when attempting to discern differences among the darker sock colors as well as when looking for variations in texture and other characteristics.

Unfortunately, bright light is not always conveniently available to one who is sorting socks or in a hurry to get dressed. Such being the case, one might be tempted to solve the dark color recognition problem by increasing the inherent color reflectivity of the actual objects being examined. At first glance such an approach might seem impractical, given the fact that most people would tend to reject the idea of wearing bright, dazzling, vividly colored socks. However, with a fundamental change in reference, the idea can be implemented to advantage:

If, instead of directing effort at examining the individual socks themselves, the sorter or wearer could simply glance at a small, brightly color-coded indicator attached to each sock, a great deal of confusion and error could be eliminated in terms of sorting, mating and color selection. Providing such an indicator in the form of a simple and practical sock tagging device is the essence of the invention.

FIRST EMBODIMENT

Description

As depicted in FIG. 1, the most primitive form of the present invention comprises two components, the first of which will be referred to as the tack 1, due to the fact that its shape is very reminiscent of a common thumbtack, featuring a rigid cylindrical piercing post 2 protruding perpendicularly from the center of a disc base, referred to as the tack disc 3. The second component is a cap 4 of somewhat hemispherical shape, and solid in composition except for a cylindrical void, or receiving hole 5, extending perpendicularly from the center of its circular base facet 6 to a point just short of breaking through to the outside.

Both the length and diameter of the tack's piercing post correspond with the dimensions of the cap's receiving hole in such a way that, when the two components are pressed firmly together, the cylindrical post having been thrust into the hole, their mutual friction of contact prevents any subsequent separation that might otherwise result from ambient, random or other prevailing forces. Though not an absolute requirement, it is suggested that the post's outer surface be fluted longitudinally, much like the fluting of a dowel used as a securing peg in the field of woodworking. Rather than being drawn to a slender, sharp point, the end of the post has an abbreviated taper to a point 7 that is relatively dull, yet sharp enough to part the woven strands of sock fabric. The abbreviated point results in greater length of the cylindrical portion of the post, thus resulting in greater surface area of the post making direct frictional contact with the interior wall surface of the cap's cylindrical receiving hole.

In regard to the actual size of the tagging device, the diameters of the tack disc and the circular base facet of the cap should be equal, or at least approximately so, and may generally fall within a practical range from 9 mm to 11 mm, although reasonably larger or smaller sizes may also be acceptable. Though approximately hemispherical in form, the dome-shaped cap should not actually constitute a full half sphere; instead, its shape should represent slightly less than a half sphere, so that, even at its very base, the rounded shape of the dome slopes inward on itself, rather than presenting a fully perpendicular protrusion from the sock fabric. The smooth, inwardly sloping form is important in preventing floating strings, threads or fibers from wrapping around or snagging themselves on the tagging device during laundering or drying cycles. In more specific terms, and with reference to FIG. 2, the dome shape should be approximately equivalent to a true hemisphere 8 which has been sliced, or truncated, parallel to and slightly above its base 9. The circular facet that remains after the slice has been removed is of a lesser diameter than that of the original base of the hemisphere, and in fact serves as the circular base facet 6 of the cap.

The dome shape provides an additional advantage in the design of the invention, for it is the only practical shape which presents a relatively consistent visual profile from a multiplicity of surrounding viewpoints, a factor of great importance in the overall use of the device.

The components of the tagging device are composed of a solid, chemically stable, homogeneous material having the characteristics of relatively light weight, low specific heat, low thermal conductivity and low coefficient of expansion. Polystyrene or other formulations of relatively hard plastic appear to be suitable, although many other varieties of materials and substances can be considered. Being small and considerably light in weight, the tagging device will not be felt by the wearer of the sock. Having the characteristic of low specific heat, the device will not tend to absorb or retain great amounts of heat generated during laundering and drying cycles, and with low thermal conductivity the device will not cause pain or undue discomfort to one who touches it while removing it from a clothes dryer. With a low coefficient of expansion the device will retain its dimensions within a limited tolerance range, insuring that its components will continue to fit together securely throughout the wide temperature swings that typically occur during washing and drying cycles. Being chemically stable and relatively inert, the material of which the device is composed will not tend to corrode or discolor when exposed to bleaching agents and other washing solvents, and will therefore be similarly unlikely to cause staining or color damage to socks and other articles of clothing with which it comes in contact.

Component coloration is a very important feature, for it is color which serves as the primary visual cue conveyed by the tagging device. Rather than using a great number of colors, shades and hues, the invention relies on the use of only those colors that are generally considered to be basic. Except for grey and black, the colors are to be as bright and easily recognized as possible. The ten colors black, grey, white, red, pink, orange, yellow, green, blue and violet are suggested, although other color varieties can certainly be used. Rather than being painted or printed onto the surfaces of the tagging device, it is preferred that the coloring pigments or agents be impregnated or mixed into the material of which the device is composed, so that the colors will not wear off and will have a greater likelihood of remaining vivid throughout many years of repeated washing and drying cycles.

Implementation

Figure 3A:
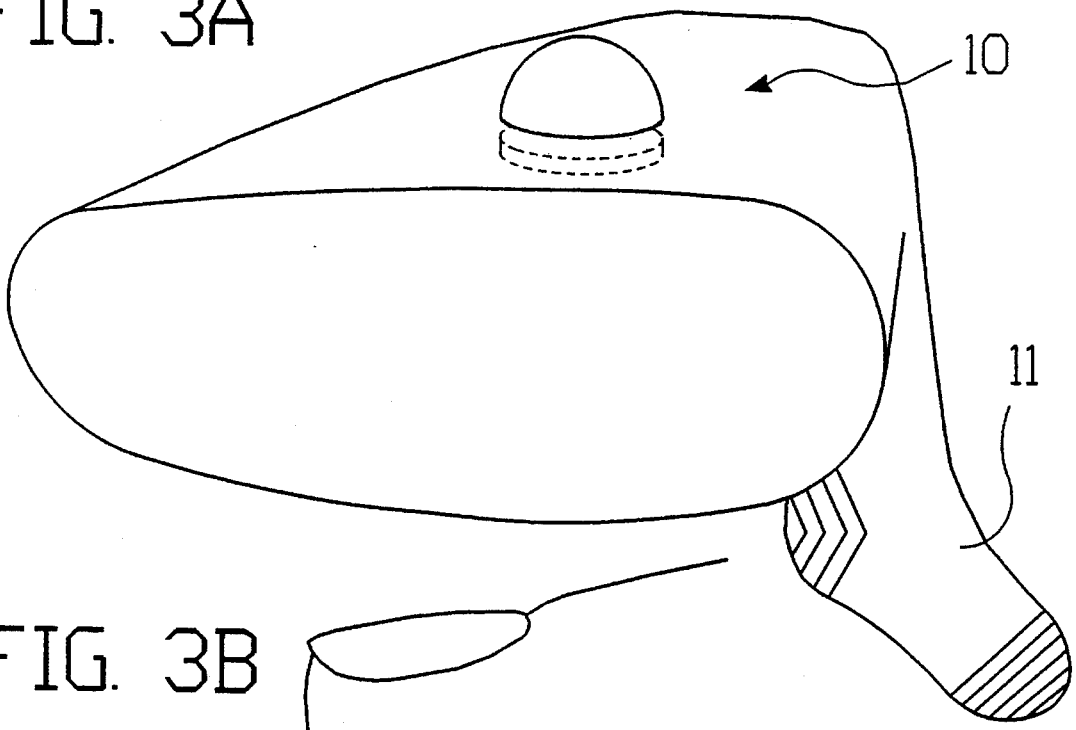
FIG. 3A shows the sock tagging device attached to the hem of a sock.
Figure 3B:
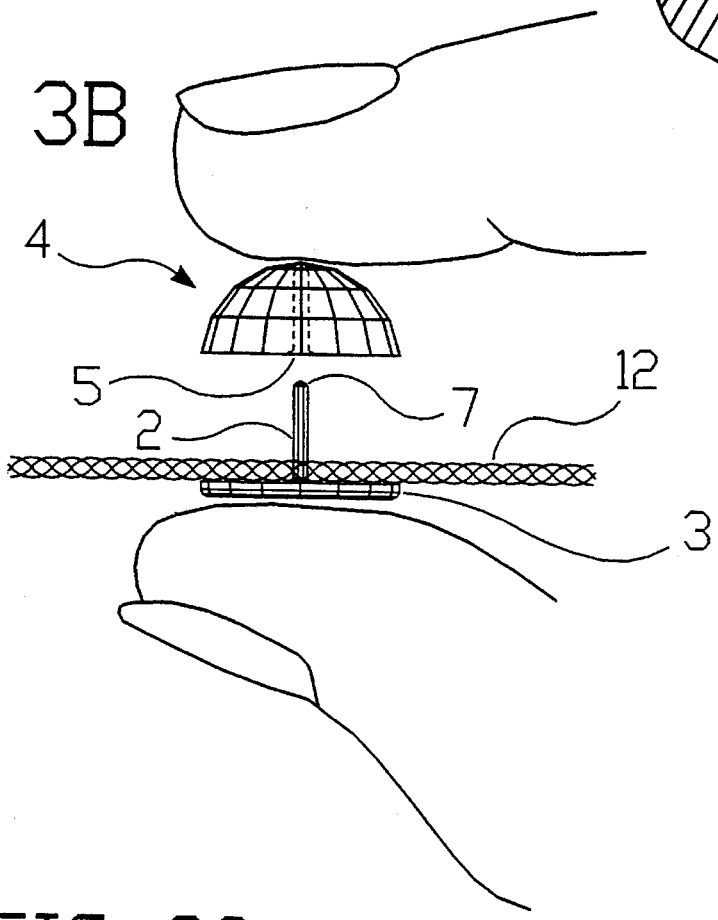
FIG. 3B shows the tack and cap about to be pressed together.
Figure 3C:
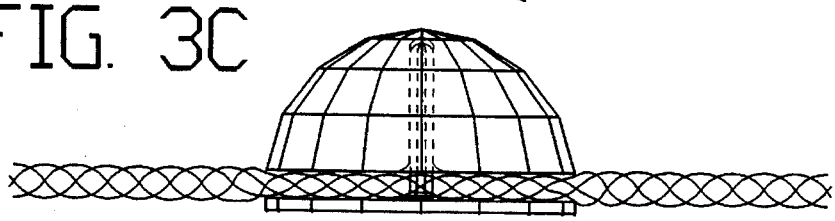
FIG. 3C shows how the tack and cap fit together as they sandwich the sock fabric.

With reference to FIGS. 3A and 3B it can be seen that the tagging device 10 is attached to the upper portion of a sock 11 by pushing the tack's piercing post 2 through the sock fabric 12 from the inner side, positioning a cap 4 on the outer side of the fabric so that the point 7 of the protruding piercing post engages the cap's receiving hole 5, then pinching the tack disc 3 and cap 4 firmly together with thumb and forefinger. The post, having thereby been thrust as deeply as possible into the cap's hole, as shown in FIG. 3C, is held securely in place by the accumulation of frictional forces shared between the post's cylindrical surface and the tightly embracing cylindrical inner wall of the cap's receiving hole.

This particularly simple method of engagement has been thoroughly tested during the development of the invention and has proven completely effective over a period of two years of rigorous wash and dry cycles. It is important to understand that this invention is not intended for use as a fastener. It is not designed to hold items together that would otherwise naturally part. The invention is a tagging device, the mechanics of which are contrived for the sole purpose of securing it to the fabric of a sock. With its light weight, diminutive size and round shape, the forces that would work to separate its two components are negligible in comparison to the typical kilogram of force used in securing them together. This invention both circumvents and obviates the need for any of the typical one-way locking, latching or snapping designs that may have been used in previous attempts at tagging socks.

Figure 4:
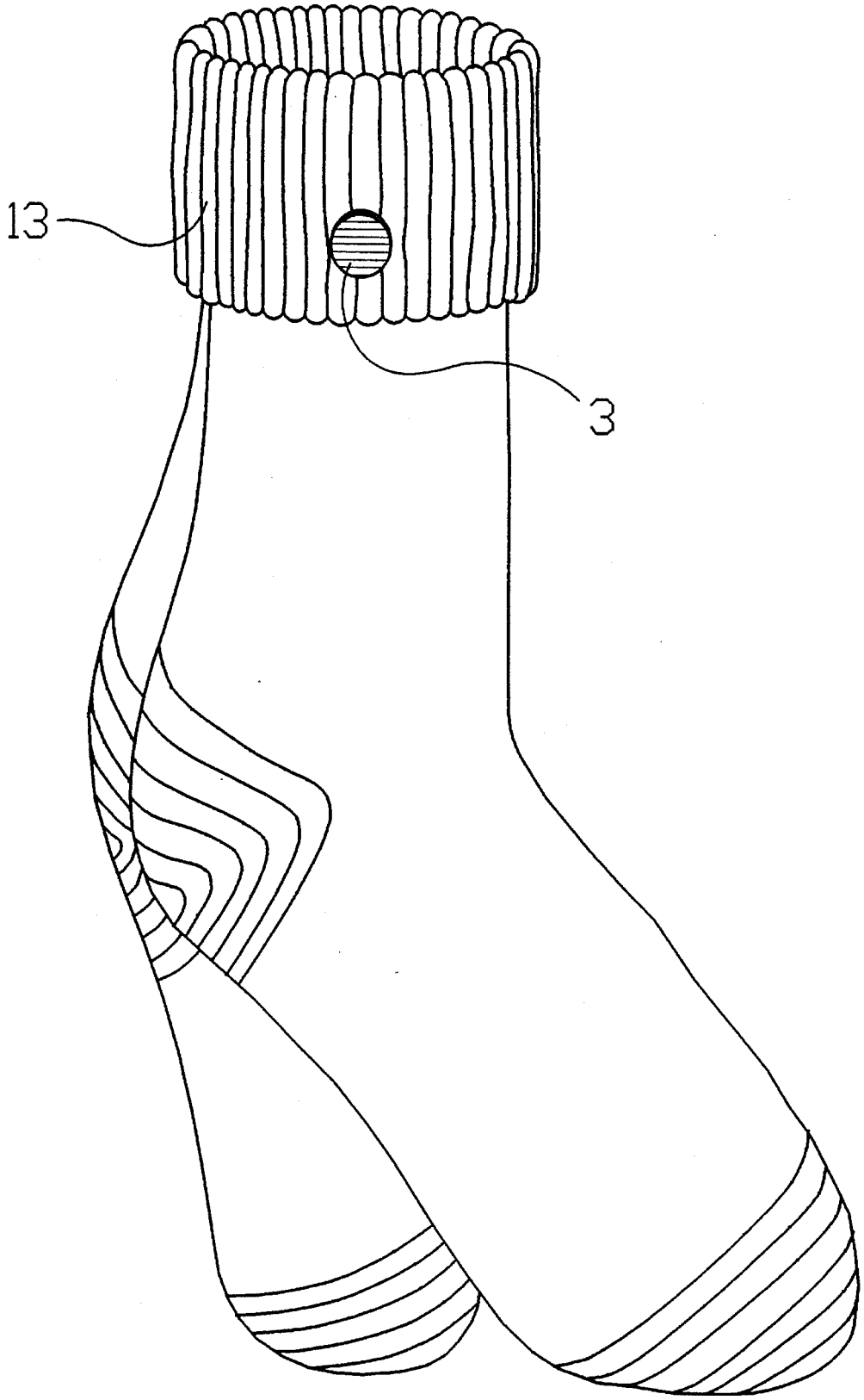
FIG. 4 shows how an over-folded sock cuff exposes the tack disc to plain view.

The two components of the sock tagging device perform separate functions in regard to their coloration. The dome-shaped cap, located on the exterior side of the sock fabric, features a particular color that is matched by the color of another corresponding cap, such matching coloration being for the purpose of facilitating the visual identification of the sock mates to which the caps have been individually attached. As each freshly laundered mate to a given sock is thus located, the sorter places the two mates alongside each other, and in standard fashion cuffs the top of one over the top of the other, as shown in FIG. 4, forming the customary loose but effective temporary coupling of the two mated socks.

It is at this point that the tack disc 3, normally located on the interior side of the sock fabric, is now visible on the inside-out portion of the over-folded sock cuff 13. Like the dome-shaped cap, the tack, and therefore the visible tack disc itself, also happens to feature a specific color of its own, but in this case one that signifies the actual color category to which the sock belongs. For example, a bright blue tack would be used in tagging a dark navy blue sock; though the sock might appear black, dark brown, or dark green in a dimly lit drawer, the brightly colored tack disc indicates to the would-be wearer that the sock is indeed blue. A white tack can be used to signify a sock whose color is not found in the spectrum and therefore falls in the neutral black-grey-white category; a yellow tack can be used to indicate a sock belonging in the brown-tan category; a green tack serves to indicate socks falling within the green category; a red tack is capable of indicating not only a conservative maroon, but also those sportier colors ranging in the red-pink category.

Figure 5:
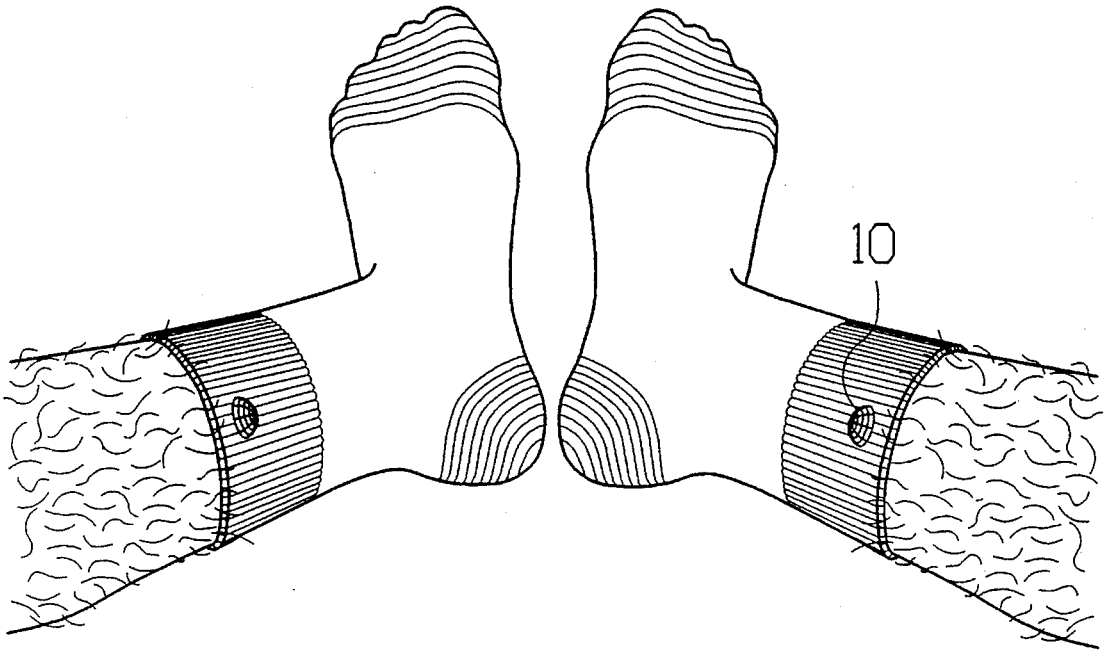
FIG. 5 shows a suggested positioning of the tagging device for greatest comfort.

It is suggested that some foresight be used in tagging a pair of socks so that, when being worn, each corresponding tagging device 10 is situated on the inner side of the wearer's upper ankle area as shown in FIG. 5. With such positioning the wearer is able, for instance, to sit in a chair and cross one leg so that the outer side of its ankle rests upon the thigh of the other leg. In such a casual sitting posture, more typically assumed by males than by females, the suggested positioning of the tagging device prevents it from getting in the way, and in fact tends to insure that the protruding dome-shaped cap is neither felt nor noticed in any way while the device is being worn throughout the day or night.

For some it may also be desirable to mount each device approximately 3 cm below the sock hem, making it possible for the wearer of shorts to conceal the presence of the device simply by folding the hem of the sock down and over the brightly colored cap.

To further illustrate the method of implementation of the invention a simple case will be used involving a bachelor, Bart, who lives alone and does his own laundry: Bart is the proud owner of twenty-three pairs of socks as the result of a recent personal sock organizing campaign. Early on a Saturday morning Bart threw away all his worn-out pairs of socks that he no longer used, as well as thirteen odd socks for which mates could not be found. Having only five decent pairs of socks left, he then went to a local department store and stocked up on several three-pair packets of socks, specifically, a packet each of black, dark brown, navy blue, charcoal grey, and two additional packets of white athletic socks.

Opening up his kit of sock tags, an assortment of variously colored versions of the invention, Bart sets to work attaching them to the array of socks laid out before him. First, he concentrates on his older, familiar socks, picking up the nearest pair of navy blues. After insuring that they are both right-side-out, he positions a bright blue tack on the upper inside of one of the socks and pushes the piercing post through the fabric. With a strong pinch between thumb and forefinger he presses a cap firmly down on the post from the other side, securing the tag to the sock. While the tack color signifies the color category to which the sock belongs, the color of the cap has no relation to the color of the sock itself; in fact it will be assumed in this instance that Bart has just secured a yellow cap to the blue sock. He now tags the sock's mate in exactly the same way, using a bright blue tack and a yellow cap. Having accomplished this, he places the mates beside each other and cuffs the top of one over the top of the other, revealing the bright blue tack disc now easily seen on the over-folded fabric.

Bart then picks up another pair of navy blue socks of a slightly different style and marks these also with bright blue tacks, this time capped with red. He cuffs one over the other as before, leaving again a bright blue tack disc showing prominently, then places the mated pair next to the other blue pair.

Next, he tags a pair of his older dark green socks with bright green tacks capped with white; then an old favorite black pair, using white tacks capped with orange; then the old dark brown pair, using a yellow tack that signifies the brown-tan color category, secured in this instance by green caps.

Now Bart opens up his new three-pair packet of black socks. As all six of these socks are identical and can be mated amongst each other in any combination, Bart tags them all in the same manner, using white tacks with purple caps. Opening up the three-pair packet of brown socks, he tags them all identically, using yellow tacks with blue caps. He finally tags the three identical new pairs of navy blue socks, using blue tacks with pink caps. He similarly tags the six new grey socks with white tacks, signifying the black-grey-white color category, and black caps, and finally tags the twelve new white socks, using white tacks and grey caps. Having now tagged all the socks and cuffed all the mates together, Bart is free to gather up all the pairs and throw them into his dresser drawer for later use.

The next stage in this illustration occurs when Bart, scheduled to be the master of ceremonies at the annual alligator cook-off festival, yanks out his sock drawer in the early hours of Sunday morning. With not a second to spare, he must quickly extract three pairs of socks appropriate for the day's activities. For the speech to be delivered in his blue serge suit, he'll need a pair of dark navy blues; for his role as judge during the afternoon alligator stretching competition, he'll require his dark greens; for the evening awards presentation, a black tie affair, he'll need a pair of blacks.

In a matter of only a few seconds Bart is able to pick out of his dimly lit drawer exactly the socks he requires. First, he grabs a dark looking pair with a bright blue disc showing; second, he picks out a pair featuring a bright green disc; immediately thereafter he takes out a dark pair featuring a white disc. Mission accomplished quickly and error-free.

At this point a side note should be included before proceeding further: The tagging device can be attached very near the upper hem of the sock, reducing the likelihood that it will be seen by others, provided the user wears pants or other garments that tend to cover the upper portions of socks; on the other hand, one might prefer to attach the device approximately 3 cm lower on the sock, so that when wearing shorts, he or she can fold the hem down and over the device, concealing it from view.

The third phase of this illustration takes place a week later, when Bart is confronted by a chaotic pile of socks which he has just pulled from the dryer and dumped on his bed. Rather than approaching this impending task with his usual disdain, Bart launches into the sorting challenge with enthusiasm. He sees two bright green dome-shaped caps, one near the very front of the pile, and the other near the right-rear; he picks up the two respective socks, cuffs them together and sets them aside.

Surprising as it may seem, Bart couldn't care less about the color, size or weave of the socks he plucks from the pile. All he is looking for are brightly colored matching caps amongst all those socks. If he spots a disc, rather than a cap, he knows that the sock to which it is attached is inside-out, a matter easily rectified.

Picking up a blue-capped sock here and a matching blue-capped sock there, cuffing them together and placing the pair aside, Bart continues, grabbing only for matching color caps. In a very short while he is done with the mating, at which time he has two options: On the one hand, he might simply throw the whole batch of paired socks in a large drawer, knowing that at any later time he'll be able to quickly select a proper pair simply by spotting the appropriate color-coded disc; on the other hand, he might just as readily choose to sort the pairs into their basic color categories right away, then place the resulting piles into specific drawers for later use. In either case the job has been accomplished quickly and efficiently.

Up to this point it can be seen how the invention facilitates both the mating of socks and the wearer's subsequent selection of a mated pair of the desired color category. Although the above illustration has served its purpose in showing how the invention can be used, its simplicity must now give way to the reality that prevails in most cases: The chances are quite good that Bart has more than ten kinds of socks that need to be distinguished from one another. It will be recalled that only ten colors were suggested earlier for use in such distinction. Despite the fact that there are many intermediate colors that the human eye can discern, it becomes rather risky when the list of ten is expanded to include additional intermediate colors that fall between the basic ones suggested. For example, bright green is easily distinguished from bright blue, even in relatively dim light. However, turquoise and aquamarine are much more difficult to distinguish from blue or from green under less than optimum lighting. The risk, of course, lies in the fact that color discrimination suffers considerably as lighting conditions deteriorate. Given the often dim and casual light accompanying sock sorting and selection, only the most easily distinguishable colors should be incorporated in the tagging device.

If, indeed, the list of usable colors is restricted to ten, Bart will have to get creative in tagging his eleventh unique sock style for mating. On that eleventh tagging he may choose to revert to the first color he used when he tagged his old blue socks, placing a yellow-capped tag in the customary position; then, immediately to the right of that one he might attach another, so that he has now created a unique mating code, which in this case is "left yellow, right yellow." For a twelfth sock style he might use the tag combination of "left yellow, right red" and proceed in such manner as each new pair or style requires a new and unique mating tag arrangement.

Unfortunately, the above solution gives rise to a problem involving visual recognition during the sock mating process. Sock mating is usually done from a pile of randomly oriented socks taken directly from a clothes dryer. The sorter, seeing a "left yellow, right blue" tag indication on the near side of the pile, and a "left yellow, right blue" indication some distance away, may instantly reach out, only to be disappointed at having grabbed two mismatched socks, one of the socks turning out to be in fact a "left blue, right yellow." Such a reversal would result from one sock having lain north-south on the pile, the other south-north. The problem, of course, is that left-right ordered pairs of colors appear reversed when turned upside-down.

SECOND EMBODIMENT

Description

Figure 6:
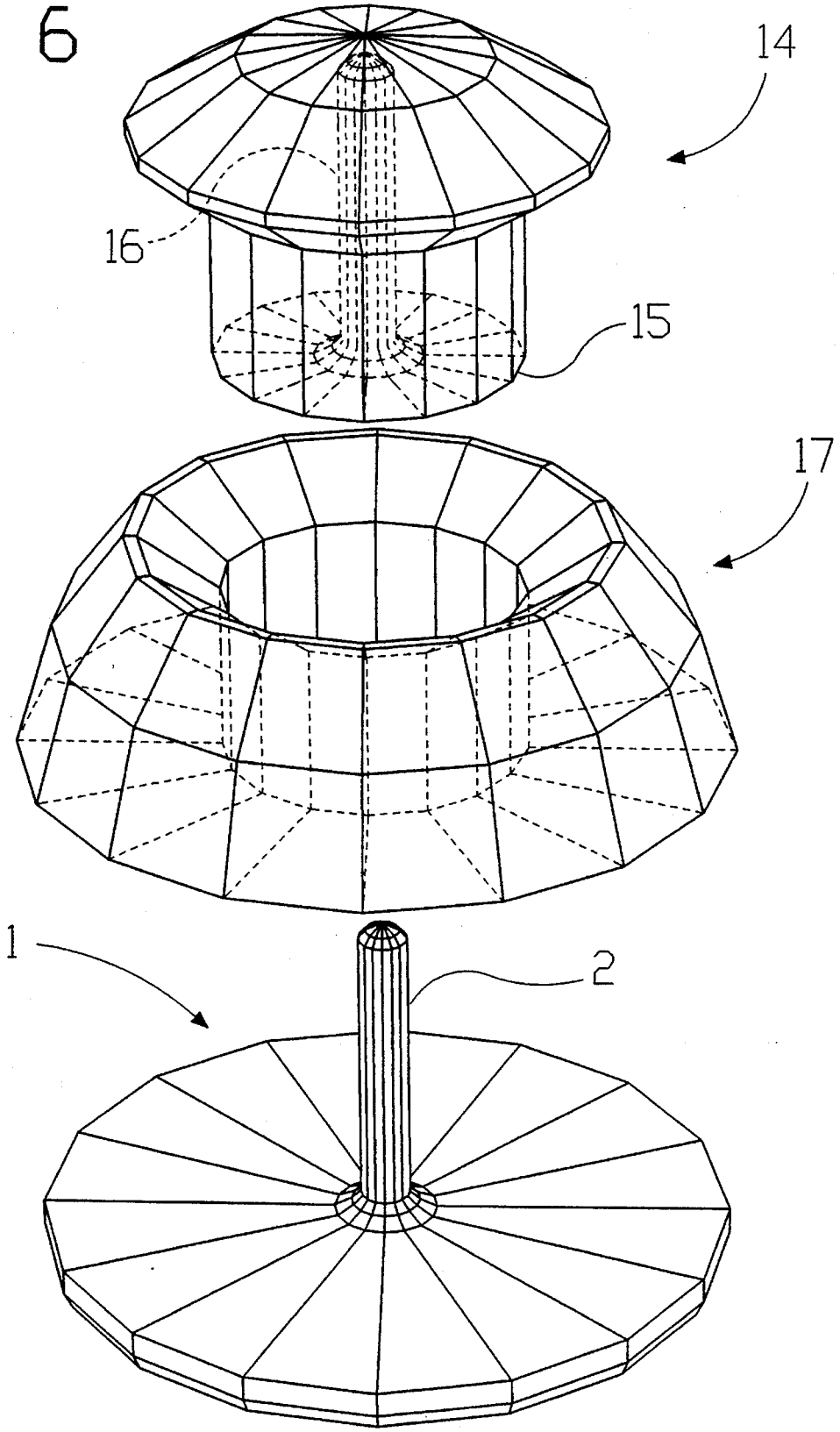
FIG. 6 shows the cap core, cap ring and tack, which are the three components of the second embodiment.

To circumvent the potential problems associated with the use of ordered pairs of sock tagging devices, a more sophisticated version of the invention is provided that utilizes dual color sequences to a more reliable advantage. This second embodiment comprises three components, two of which can be considered fractions of the dome-shaped cap earlier described. With reference to FIG. 6 it can be seen that the central component, or cap core 14, has a circular base facet 15 of approximately ⅜ the diameter of the circular facet of the cap featured in the first embodiment; in this case the facet serves as the base of a cylinder. As the cylinder achieves a height of approximately ½ the height of the cap featured in the first embodiment, it widens out at an angle of approximately forty-five degrees until the structure attains a diameter approximately ⅔ that of the base. From that point upward the structure of the core reverts to an accelerating regression to zero diameter such that it forms the upper central portion of a potential dome-shaped cap. The cap core's receiving hole 16, being of the same diameter and length as that in the first embodiment, extends perpendicularly from the center of the base facet to a point just short of breaking through the top of the core.

The second component of the cap is a ring-like structure, referred to as the cap ring 17, whose inner surfaces are designed and shaped to accommodate the outer diameters and angles of the cap core, and whose outside surface is curved to complement the curvature of the core's top surface, such that when the core sits centered upon the ring, the two fit precisely and intimately together to form a completed dome-shaped cap. It should be understood that the relative dimensions and shapes of the core and ring as described above are not of critical importance to the invention, but serve rather to provide a workable approximation of the preferred embodiment.

The third component is the tack 1 that appears in the first embodiment, and whose piercing post 2, in exactly the same manner as before, is thrust firmly into the cap core's receiving hole 16 to effect secure attachment. Although the tack itself is never in direct physical contact with the cap ring, it does in fact anchor the entire tagging device in place by sandwiching the ring between the cap core and the sock fabric, as will be seen in FIG. 8 later in this discussion.

Implementation

Both the cap core and the cap ring participate in presenting an ordered pair of colors that cannot be misconstrued by changes or reversals in the physical placement or orientation of the socks. For example, if the core is white and the ring is blue, the color combination read from the center outward is "white, blue." No matter how the socks thus tagged are arranged on the random pile, no matter from what angle the tags are viewed, they always appear the same from center outward, namely "white, blue."

Utilizing the core and ring configuration described above, and equipped with a variety of core and ring components available in all of ten basic colors, Bart, the bachelor in the earlier illustration, can now individually tag up to one hundred varieties of socks. With reference to the grid chart of FIG. 7, in which ten core colors are arranged horizontally along the top, and ten ring colors are listed vertically along the left, it can readily be seen that the number of possible ordered combinations is equal to ten multiplied by ten.

With reference now shifting to FIGS. 8A, 8B and 8C it can be seen that the process of attaching the tagging device to the sock fabric 12 is virtually the same as that described earlier, except for the fact that the cap in this embodiment comprises two components. The dual-color, dual-component cap 18, shown in FIG. 8C, is configured and attached simply by placing the cap ring 17 of a chosen color over the piercing post 2, as shown in FIG. 8A, positioning the cap core 14 of a chosen color so that the post's point 7 engages the core's receiving hole 16, shown in FIG. 8B, then pinching the cap core and tack disc toward each other with a firm pressure, causing the post to be thrust as deeply as possible into the core's receiving hole. As core 14 and ring 17 are pressed together their surface angles cause them to align with each other so as to form the completed dome-shaped cap when fully engaged, as shown in FIG. 8C.

Using the two-color cap codes makes the mating of socks very fast and easy during the sorting process. The bright colors in concentric arrangement enhance the sorter's visual recognition of the two-color code sequences. The sorter simply mates, for example, one sock with a "red center, yellow ring" cap to another sock featuring a "red center, yellow ring" cap. There is no requirement for cleverness, nor intellectual analysis on the part of the sorter. In fact, with very little practice the eyes and hands may almost seem to do the bulk of such sorting on their own, good news to the sorter who sits in front of the television.

This second embodiment of the invention, as helpful as it is when it comes to the mating of larger numbers of socks, still leaves some room for further improvement. Up to the present the discussion has featured Bart, the bachelor, for purposes of illustration. However, for more practical, realistic and universal considerations it will be good to place attention from this point forward on the sorting situation found in the typical family.

THIRD EMBODIMENT

In the family household the sorter of a given load of freshly laundered socks is not only faced with the task of mating them into pairs, but also sorting those resulting pairs for distribution. In the typical sock mating process two matching socks are held side by side, toes hanging downward, at which point the upper open end of one is everted and folded down so that the resulting cuff encompasses and binds together the upper portions of both socks. In effect the over-folded cuff is turned inside-out, hiding from view the dome-shaped cap, and exposing instead the circular tack disc, whose bright color signifies the actual color category of the sock pair. It is during this intermediate stage, between the point at which the socks have been cuffed together, and the point at which they are selected for use by the wearer, that an additional piece of information will be useful to the sorter or distributor.

Description

Given the fact that the process of sorting for distribution typically and most effectively takes place after the mated socks have been joined by cuffing as described above, one would then look for an indication of ownership presented by the tagging device to appear on the tack disc side and portion of the fabric, which is now exposed to view.

Figure 9:
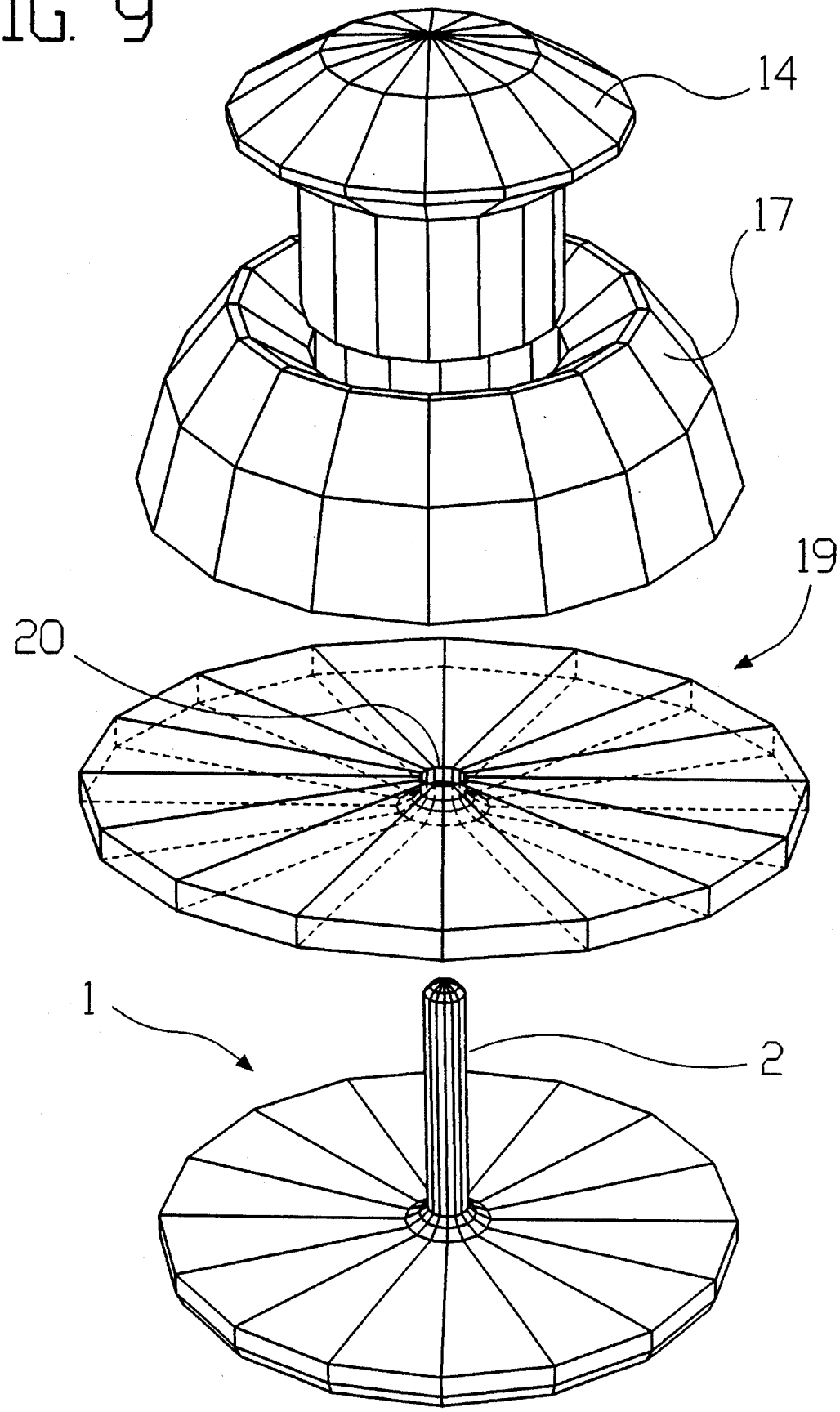
FIG. 9 shows the cap core, cap ring, tack and washer, which are the four components of the third embodiment.
Figure 10A:
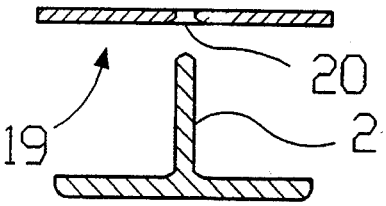
FIG. 10A shows the washer as it is positioned over the tack's piercing post.
Figure 10D:
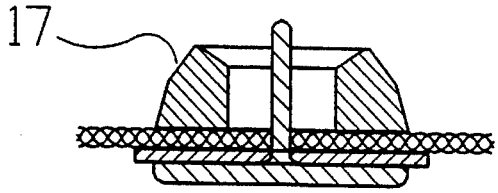
FIG. 10D shows the cap ring placed over the protruding piercing post, while the washer is sandwiched between the tack disc and fabric.
Figure 10E:
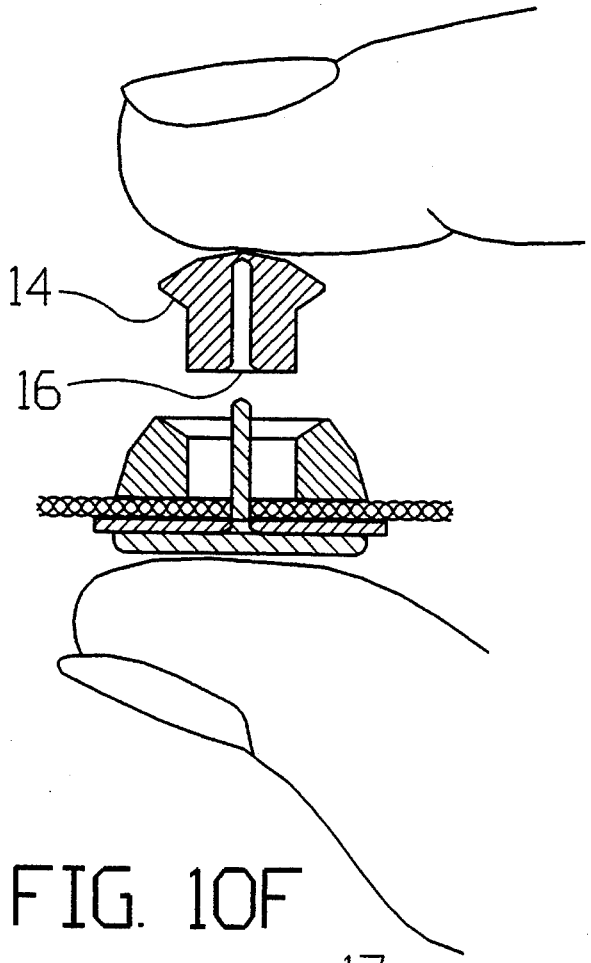
FIG. 10E shows the cap core being pressed into position for attachment.
Figure 10B:
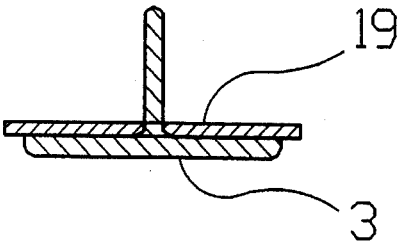
FIG. 10B shows the washer having been slid down the piercing post to rest against the tack disc.
Figure 10C:
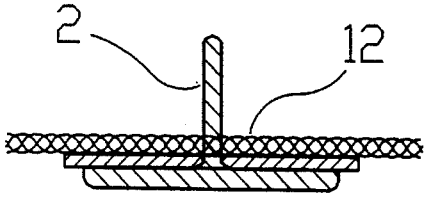
FIG. 10C shows the tack and washer after the tack's piercing post has penetrated the sock fabric.
Figure 10F:
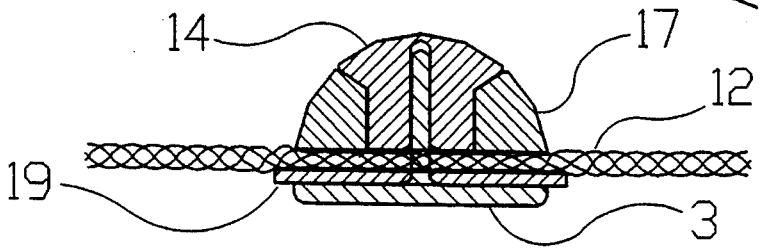
FIG. 10F shows the four-component device of the third embodiment seated fully into position, sandwiching the sock fabric between the washer and cap ring.

Therefore, the third embodiment of the invention comprises the three components of the second embodiment with an additional fourth component whose purpose is to serve as an indicator of sock ownership. In FIG. 9, which shows cap core 14, cap ring 17, and tack 1, it can be seen that the fourth component is nothing more than a washer 19 in the form of a thin disc with a central hole 20 large enough to accommodate the penetration of the tack's piercing post 2. This washer, serving to identify the sock owner, is brightly colored and of a larger diameter than that of the tack disc.

Implementation

Attaching this four-component tagging device to a sock involves the following steps, as depicted in FIGS. 10A through 10F: First, with reference to FIG. 10A, the central hole 20 of the owner identification washer 19 is positioned over piercing post 2, and the washer is slid down to rest on tack disc 3, shown in FIG. 10B, much in the same way that a flat metal washer is placed on a machine bolt; second, referring now to FIG. 10C, piercing post 2 is then pushed through the sock fabric 12 from the inside; then, shown in FIG. 10D, cap ring 17 is placed over the protruding post on the outer side of the fabric; finally, in FIG. 10E, the receiving hole 16 of cap core 14 is positioned over the end of the post and then pressed down firmly with a thumb and forefinger pinch of tack disc and cap, resulting in the completed attachment depicted in FIG. 10F in which ring 17, fabric 12 and washer 19 are snugly sandwiched between tack disc 3 and cap core 14.

Figure 11:
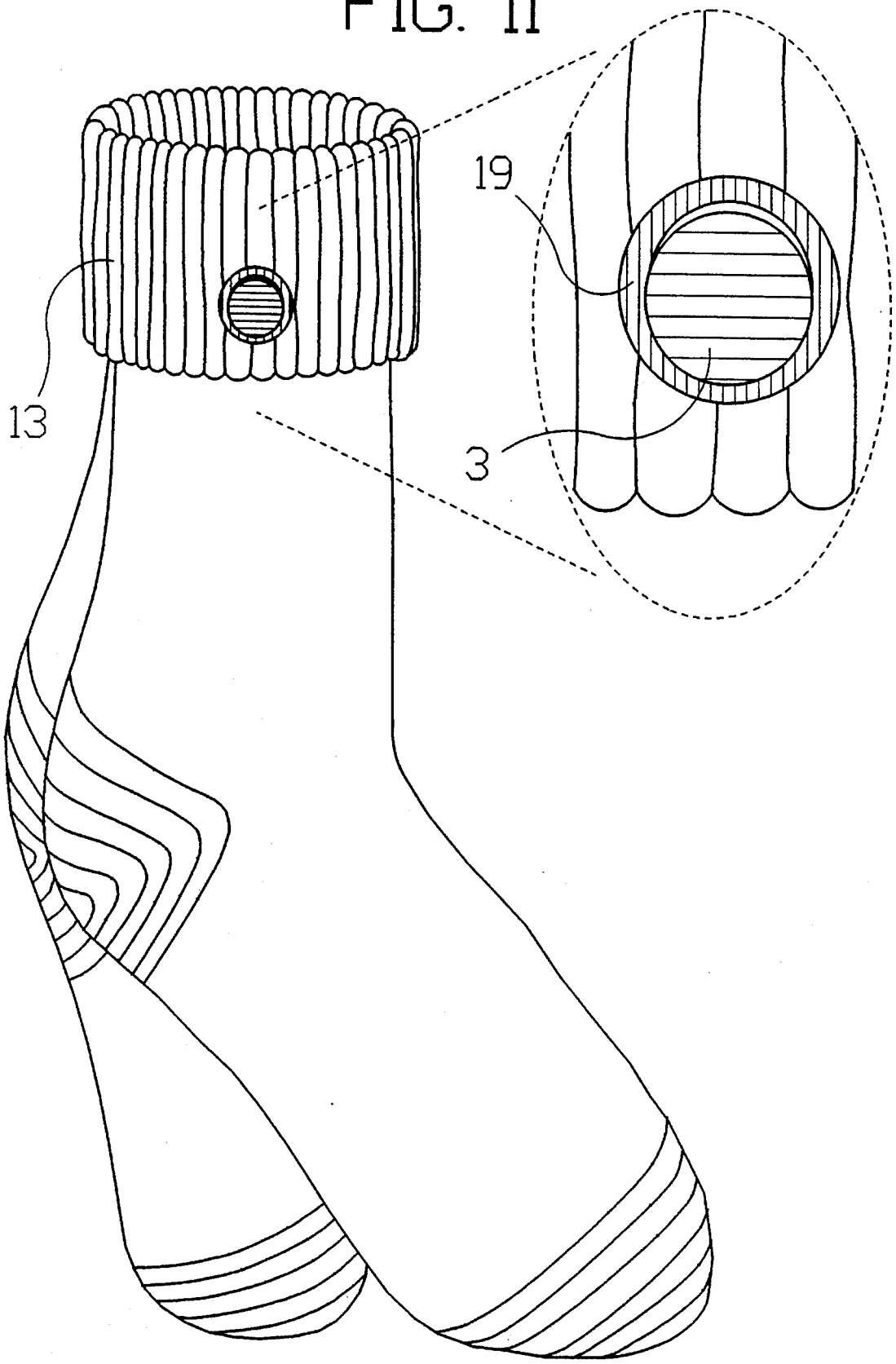
FIG. 11 shows the tack disc and the surrounding exposed peripheral portion of the washer which underlies it, both being visible on the over-folded sock cuff.

As mentioned earlier, the owner-identifying washer should be of a recognizable and preferably bright color. It is to be understood that the color of the washer has no relation to the sock's color category or mating code, and therefore may simply be a favorite color chosen by the particular family member to whom it relates. With reference to FIG. 11, although washer 19 ends up sandwiched between tack disc 3 and the fabric of the over-folded sock cuff 13, its larger diameter allows its outer edge to be seen as a brightly colored concentric ring encircling the tack disc. From the sorter's point of view the particular color of that surrounding ring indicates the ownership of the sock.

Summary

One of the most important virtues of the invention is its practical simplicity. Completely circumventing any need for locking or latching mechanisms, the tagging device maintains secure attachment by way of no more than its own internal friction. Without having to use tools of any kind, one attaches the device by simply pinching its components firmly together. Likewise, the invention's method of presenting information to the user is straightforward and simple, obviating any need for numerals, letters, pictures or symbols, all of which can require a certain acuity of vision, and all of which can appear to be different when inverted or seen from various angles.

In regard to the dome-shaped cap itself, it is one of the simplest and most effective shapes for providing uniform visibility over a wide range of viewing angles, an important aspect when dealing with a random pile of freshly laundered socks. The dome shape also offers maximum protection from entanglement, providing negligible resistance to the passing of stray threads, strings and fibers. Furthermore, the dome shape is very well suited to the use of concentric color coding, which is vitally important to insure that a given color sequence cannot appear to be reversed, even in situations involving radically changed physical or visual orientations.

Upon review of the foregoing description it can be seen that the present invention indeed achieves the objects and yields the advantages earlier set forth, providing:

A. a sock tagging device whose mechanism for attachment is both simple and reliable, eliminating any need for latching or locking schemes;

B. a sock tagging device whose physical design and form is immune to snagging and entanglement by loose or stray threads during laundering;

C. a sock tagging device that conveys information without the use of letters, numerals, written characters, written symbols or written designs of any kind;

D. a sock tagging device whose visual cues can easily be seen and recognized from a wide range of viewing angles;

E. a sock tagging device capable of conveying a visual indication that facilitates the rapid and accurate mating, or pairing, of socks;

F. a sock tagging device that presents an easily recognizable indication of the color category to which a sock, or pair of socks, belongs;

G. a sock tagging device that presents an easily recognized indication designating the ownership of a given sock;

H. a sock tagging device that presents an easily recognized indication of the inside-out, right side-out status of a given sock.

Scope and Ramifications

Although the entire foregoing description contains many specificities, particularly relating to the method by which the invention is implemented, these should not be construed as limiting the scope of the invention. Such specificities should rather be understood as merely providing illustrations of some of the preferred embodiments of the invention. For example, beyond its application to socks, the invention could also be used for tagging items such as mittens and gloves, as well as other objects that one would want to organize into pairs, trios, quartets and even larger groupings, such objects not necessarily being items of wearing apparel. It is also possible that the invention could be used as a visual indicator of ownership whereby, for example, one could apply the color coded tagging device to the exposed fabric of a folded umbrella, making the umbrella more easily identifiable among a large group of similar ones deposited in the entry way of a building. Thus the scope of the invention should be ascertained by the appended claims and their legal equivalents, rather than by the examples given.

What I claim is:

1. A sock tagging device to be used in multiplicity comprising firstly a penetrating component made of solid material which, because its form resembles that of a common thumbtack, will hereinafter be referred to as the tack, having a solid, cylindrical piercing post protruding perpendicularly from the center of a disc base which will henceforth be referred to as the tack disc, secondly a cap core made of solid material, having a cylindrical receiving void extending perpendicularly from the center of its circular base facet to a point just short of emerging from the cap core material, and thirdly a cap ring made of solid material through which said cap core can be partially inserted such that both core and ring, when mated in such manner, form a composite cap in the shape of a dome, having hemispherical appearance, and hereinafter referred to as the cap, said cylindrical receiving void of said cap core being of a diameter corresponding in such a way with the diameter of the aforementioned piercing post that when said piercing post is forced deeply into said receiving void sufficient friction is generated between the exterior cylindrical surface of the inserted post and the interior cylindrical surface of the cap core material to cause said tack and said cap core, bearing its accompanying cap ring, to remain coupled and resistant to ambient and prevailing forces that would otherwise tend to separate them, such that when the piercing post of the tack is pushed through the fabric of a sock and then forced deeply into the receiving void of the cap core, thereby sandwiching the sock fabric between the tack disc and the base facet of the cap core, the tack and cap remain securely affixed to the sock, and whereby the tack, cap core and cad ring each independently bear any one of a multiplicity of distinctive colors.

2. A method for tagging socks, utilizing in multiplicity the sock tagging device according to claim 1, for the purpose of facilitating their mating, sorting and selection, whereby one concerned with the tagging of socks firstly establishes a number of sock color categories, such as blue, green, brown, red and neutral, and then creates a standard color coding scheme by which the color borne by said tack serves to indicate the color category to which a given sock belongs, so that, if one were to tag a dark blue sock, one might choose to utilize said tack of a bright blue color while, if one were to tag a dark brown sock, one might select said tack bearing bright yellow and, if one were to tag a black sock, one might choose said tack of white, which could signify a neutral category ranging from black through grey to white, then, having established such color coding scheme, secondly selects a pair of freshly laundered, right side out and properly mated socks to be tagged, notes the color category to which they belong, then further selects from a multiplicity of said tack two tacks of an appropriate color that, corresponding with the established color coding scheme, will signify the color category of the sock pair being tagged, then thirdly selects from a multiplicity of said cap core, and from a multiplicity of said cap ring, two cap cores whose colors are identical to each other, as well as two cap rings whose colors are identical to each other, and forthwith joins the two cap cores to the two cap rings, thereby forming a pair of caps, each of the two caps displaying identical concentric color sequences, then, the caps thus assembled, fourthly pushes the piercing post of one of the selected tacks through the upper fabric of one of the socks of the pair from the inner side, positions one of the assembled caps on the outer side of the fabric so that the receiving void of the cap core engages the end of the protruding piercing post, then with pinching action of thumb and forefinger squeezes the cap and tack toward each other so that the piercing post is thrust as deeply into the receiving void as possible, causing the cap and the tack to be securely united as they sandwich the sock fabric firmly between themselves, then, using the other assembled cap and remaining tack, tags the second sock of the pair in exactly the same manner, then fifthly, placing the two socks beside each other, everts the upper, open end of one sock, drawing it back over itself so that it also embraces the upper portion of its mate, thereby temporarily binding the two together as a pair and thereby also inverting the portion of sock fabric to which the tagging device is attached so that, instead of the cap being visible on the exterior, it is the tack disc itself that is thus exposed to view, displaying the color that in turn signifies the color category of the sock pair, then, having thus tagged and joined the first pair, proceeds with the remainder of the tagging task by similarly tagging subsequent pairs in accordance with the established color coding scheme that relates to tack color, while ensuring that the unique dual color combination of a particular cap attached to a given sock is shared only by another cap attached to the appropriate mate of that given sock, understanding that in a case involving multiple pairs of identical socks wherein interchangeability is acceptable the color combination of a particular cap attached to a given sock may be shared by several caps, each being attached to an appropriate mate of the given sock, then, after all sock tagging and joining has been accomplished, sixthly places the sock pairs in their customary storage locations for later use, with the result that a person of normal vision to whom those sock pairs belong can approach the collection of sock pairs thus deposited in his or her customary sock storage location and visually ascertain the color category of any particular joined pair, even under relatively dim lighting conditions, by noting the bright and distinctive color of the exposed tack disc featured on such a pair, and with the further result that a person who is concerned with the mating of socks that have been freshly laundered and dried, and which therefore are randomly mixed among a pile, is able to not only rapidly identify sock mates simply by visually locating caps of the same distinctive dual color combination, but also to quickly identify those socks whose inner sides are turned outward by simply observing that their tack discs, rather than their caps, are exposed to view, such rapid identifications facilitating the overall task of mating and sorting socks.

3. The method for tagging socks according to claim 2, further including a procedure whereby the person concerned with the tagging of socks slides said washer which is of a chosen color signifying the sock owner, down over the piercing post of the tack before using the tack to pierce the fabric of the sock, then continues with the tagging process as otherwise established, with the result that a person concerned with not only the mating, but also the sorting and distribution of socks to their proper owners, can quickly and easily ascertain the ownership of any mated and joined pair simply by observing the color of the peripherally exposed portion of the washer, which appears as a distinctively colored ring surrounding the tack disc.

4. The sock tagging device according to claim 1, further comprising a thin, round, flat washer of an outer diameter somewhat greater than that of the tack disc, said washer having a central void of a diameter just great enough to accommodate the penetration of the tack piercing post, so that, before the piercing post is thrust through the sock fabric, said washer can be slipped onto the piercing post and moved down to sit flush against the inside surface of the tack disc, said washer also bearing one of a multiplicity of bright and distinctive colors so that, when sandwiched between the tack disc and sock fabric as a result of application, the peripheral portion of said washer can be seen to appear as a distinctively colored ring surrounding the tack disc.

* * * * *